US007080664B1

(12) United States Patent
Ayer

(10) Patent No.: US 7,080,664 B1
(45) Date of Patent: Jul. 25, 2006

(54) FLUID AMPLIFIER WITH MEDIA ISOLATION CONTROL VALVE

(75) Inventor: George Ayer, Concord (CA)

(73) Assignee: Crystal Fountains Inc., Concord (CA)

( * ) Notice: Subject to any disclaimer, the term of this patent is extended or adjusted under 35 U.S.C. 154(b) by 0 days.

(21) Appl. No.: 11/133,181

(22) Filed: May 20, 2005

(51) Int. Cl.
*F15C 3/00* (2006.01)

(52) U.S. Cl. ..... 137/832; 137/826; 137/831; 137/834; 137/870; 251/368

(58) Field of Classification Search ..... 137/829, 137/832, 834, 870, 878, 831; 251/368
See application file for complete search history.

(56) References Cited

U.S. PATENT DOCUMENTS

| | | | | |
|---|---|---|---|---|
| 3,266,512 | A | 10/1966 | Turick | |
| 3,402,727 | A | 9/1968 | Boothe | |
| 3,496,955 | A | 2/1970 | Ziemer et al. | |
| 3,521,654 | A * | 7/1970 | Brautaset et al. | 137/831 |
| 3,568,700 | A | 3/1971 | Verhelst et al. | |
| 3,583,419 | A | 6/1971 | Griffin | |
| 3,593,733 | A | 7/1971 | Roffman et al. | |
| 3,613,706 | A | 10/1971 | Hodges | |
| 3,667,489 | A | 6/1972 | Blaiklock et al. | |
| RE27,712 | E * | 7/1973 | Becker et al. | 137/831 |
| 3,770,021 | A | 11/1973 | Garner et al. | |
| 3,785,390 | A | 1/1974 | Taylor | |
| 4,000,757 | A | 1/1977 | Freeman | |
| RE30,870 | E | 2/1982 | Inoue | |
| 4,373,553 | A | 2/1983 | Drzewiecki | |
| 5,195,560 | A | 3/1993 | Achmad | |
| 5,524,660 | A | 6/1996 | Dugan | |
| 5,653,422 | A * | 8/1997 | Pieloth et al. | 251/129.2 |

* cited by examiner

*Primary Examiner*—A. Michael Chambers
(74) *Attorney, Agent, or Firm*—Bereskin & Parr

(57) ABSTRACT

A fluid amplifier is presented. The fluid amplifier comprises at least one control valve for controlling at least one of a first control fluid flow and a second control fluid flow. That is, the control valve has a movable element for selectively opening and closing at least one of the first control stream channel and the second control fluid flow channel. The control valve also includes a diaphragm for isolating the moveable element.

8 Claims, 7 Drawing Sheets

FLUID AMPLIFIER WITH MEDIA ISOLATION CONTROL VALVE

FIELD OF THE INVENTION

This invention relates generally to fluid amplifiers for decorative fountains. More particularly, it relates to a fluid amplifier incorporating a media isolation control valve for managing control fluid flow.

BACKGROUND OF THE INVENTION

Decorative fountain systems employ fluid amplifiers to generate their decorative displays and effects. Fluid amplifiers rely on a fluid control stream to switch a fluid power stream.

Fluid amplifiers are so named because a low-energy fluid control signal can control and switch a high-energy fluid power stream to produce an output signal of higher energy level than the fluid control signal. In fluid amplifiers, a fluid power stream, after leaving a nozzle, is switched selectively to one or more of a plurality of outlet passages. This may be done by supplying fluid control pressure continuously, or as a pulse, to one of the control ports at the exit end of the nozzle until the high-energy power stream is diverted. Alternatively, switching may be effected by closing the other control port so that the fluid that is flowing in through one control port from the atmosphere or some other source will create a sufficient fluid pressure imbalance adjacent the exit end of the nozzle to effect switching of the fluid power stream.

In use, a fluid amplifier would typically be connected to, and receive the high-energy power stream from, a separate fluid supply manifold that had been previously installed.

SUMMARY OF THE INVENTION

In accordance with an aspect of the present invention, there is provided a fluid amplifier comprising: (a) an interaction chamber; (b) an upstream conduit for issuing a power stream flow into the interaction chamber; (c) a plurality of output channels located downstream of the interaction chamber; (d) a first control stream channel in fluid communication with the interaction chamber for controllably directing a first control fluid flow into the interaction region; (e) a second control stream channel in fluid communication with the interaction chamber for controllably directing a second control fluid flow into the interaction region; and, (f) at least one control valve for controlling at least one of the first control fluid flow and the second control fluid flow, the at least one control valve having a movable element for selectively opening and closing at least one of the first control stream channel and the second control stream channel, and a diaphragm for isolating the moveable element.

BRIEF DESCRIPTION OF THE DRAWINGS

For a better understanding of the present invention, and to show more clearly how it may be carried into effect, reference will now be made by way of example to the accompanying drawings, in which.

DETAILED DESCRIPTION OF PREFERRED EMBODIMENTS OF THE INVENTION

Figure 1:
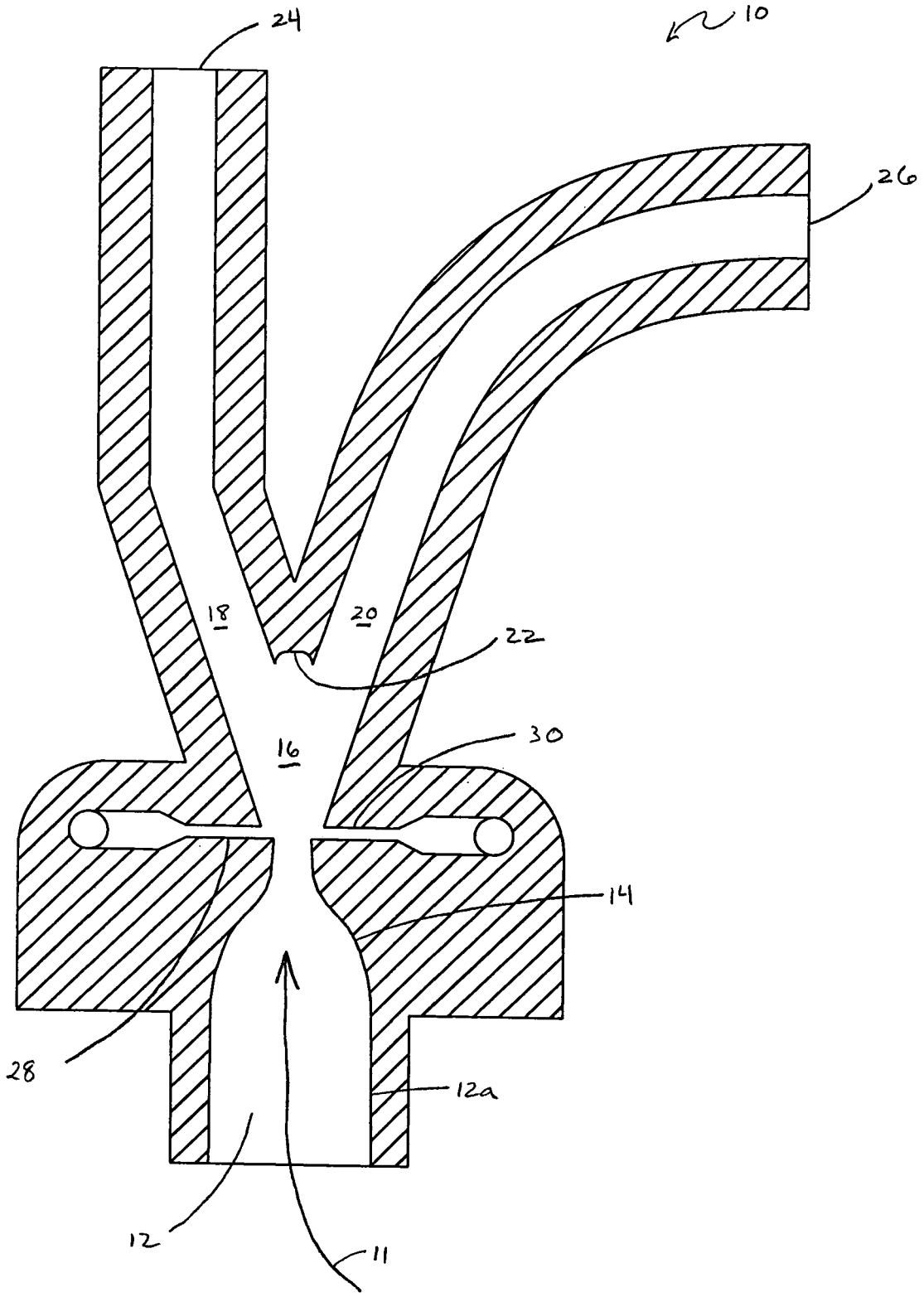
FIG. 1, in a cross-sectional view, illustrates a fluid amplifier.

Referring to FIG. 1, there is illustrated in a sectional view a fluid amplifier 10. Fluid amplifier 10 comprises a plurality of interconnected fluid channels formed in a body of fluid impervious material. A power stream input channel 12 receives an input stream 11 from supply line connected to a pump or other fluid source (not shown) with sufficient flow and pressure to create the desired visual water effect. Input channel 12 terminates at a power nozzle 14. Power nozzle 14 is, in turn, in fluid communication with a fluid interaction chamber 16. Power nozzle 14 produces a power stream flow, from input stream 11, which power stream emerges into the interaction chamber 16.

Branching from the interaction chamber 16 are two power stream output channels 18 and 20, either of which are capable of receiving the entire power stream from power nozzle 14. These power stream output channels 18 and 20 diverge at a splitter 22. The first power stream output channel 18 communicates with a display port 24, which is used to create a primary effect, such as a vertical fountain. The second power stream output channel 20 communicates with an exhaust port 26, which is connected to an elbow (not shown) that directs the fluid back into the fountain basin. Alternatively, the second exhaust port 26 could be used to create a secondary visual effect.

Figure 2:
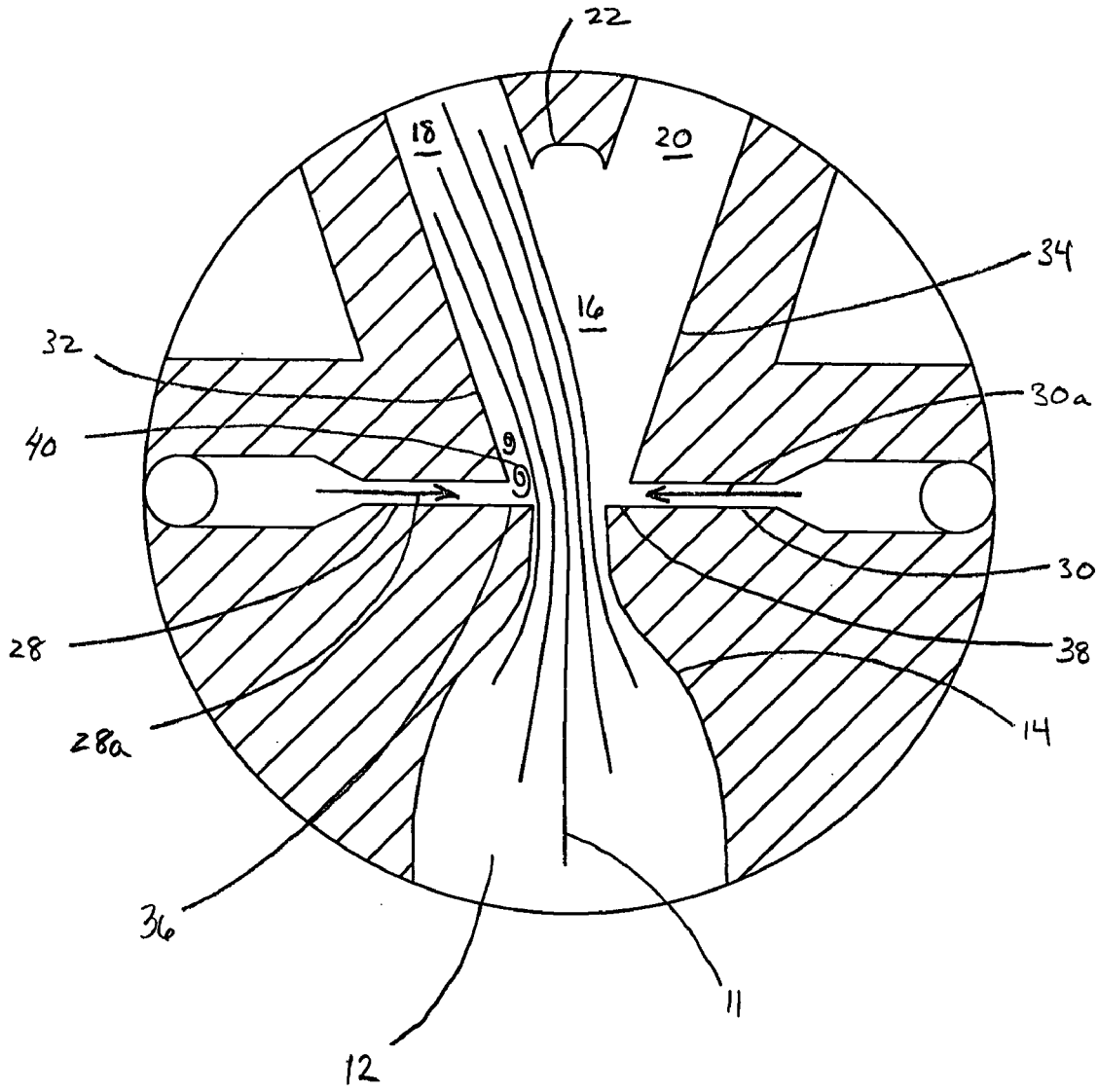
FIG. 2, in an enlarged cross-sectional view, illustrates flow characteristics of the fluid amplifier of FIG. 1.

As shown in more detail in the expanded sectional view of FIG. 2, two opposed control stream channels 28 and 30, are operable to provide counteracting control stream fluid flows 28*a* and 30*a* respectively. Control stream channels 28 and 30 are supplied with their respective control fluid flows from external sources (not shown). Each of the control stream channels 28 and 30 is individually controllable to control the control fluid flows 28*a* and 30*a* respectively supplied.

In operation, the input stream 11 from the input channel 12 is accelerated through the power nozzle 14 into the interaction chamber 16. Say that the fluid pressure provided by control stream 28*a* from control stream channel 28 is lower than the fluid pressure provided by control stream 30*a* from control stream channel 30. As a result, the power stream flowing from the power nozzle 14 will be slightly closer to a side wall 32 of interaction chamber 16 then to an opposite side wall 34 of interaction chamber 16. Side wall 32 of interaction chamber 16 is also the extended outermost side wall of first power stream output channel 18. Similarly, side wall 34 of interaction chamber 16 is the extended outermost side wall of the second power stream output channel 20.

This difference in fluid pressure provided by control streams 28*a* and 30*a* will cause the power stream flow axis to move toward the side wall 32. This increases the velocity of the fluid flowing adjacent to side wall 32, thereby effecting a further reduction in pressure between the power stream and the side wall 32. As a result, the power stream will continue to bend toward the side wall 32 until it finally "attaches" to side wall 32 and follows its curvature. This "boundary layer" effect may be enhanced by slightly offsetting side walls 32 and 34 with respect to the side walls of nozzle 14 to form sharp extension edges 36 and 38 at the exit of power nozzle 14. As a result of sharp extension edge 36, and the power stream being moved towards side wall 32 by control streams 28*a* and 30*a*, a low pressure bubble 40 is formed immediately downstream of sharp extension edge 36.

Thus, as shown in FIG. 2, the power stream flow exits through the first power stream output channel 18 and display port 24 due to the "boundary layer" region existing between the power stream and side wall 32. This boundary layer can be destroyed by providing a relatively low energy control stream 28*a* from control stream channel 28 into interaction chamber 16. At some point, the control stream 28*a* provided to the boundary layer between side wall 32 and the power stream will disrupt this boundary layer, such that power stream is no longer held against side wall 32. As a result, the power stream will swing back toward the centre of the interaction chamber 16. In so doing, the power stream entrains fluid between it and the opposing side wall 34. Eventually, the power stream will switch to flow through the second power stream output channel 20 because of the boundary layer attachment between the power stream and side wall 34 of interaction chamber 16 and power stream output channel 20. The flow of the power stream in either power stream output channel 18 or 20 is stable in that once a suitable boundary layer has been created there is no need for continuous application of control stream flow 28*a* and 30*a* from either control stream channel 28 or 30 to maintain attachment.

The control stream fluid provided in control stream channels 28 and 30 would typically be air; however, other working fluids, such as water, might possibly be used. Accordingly, switching may alternatively be effected by "closing" control stream channel 30, thereby shutting off the control stream 30*a* such that the control stream 28*a* entering the interaction chamber 16 from control stream channel 28 will create sufficient pressure imbalance across the power stream flow to effect switching. The control streams 28*a* and 30*a* may be provided from the atmosphere, or some other positive pressure source.

Figure 3:
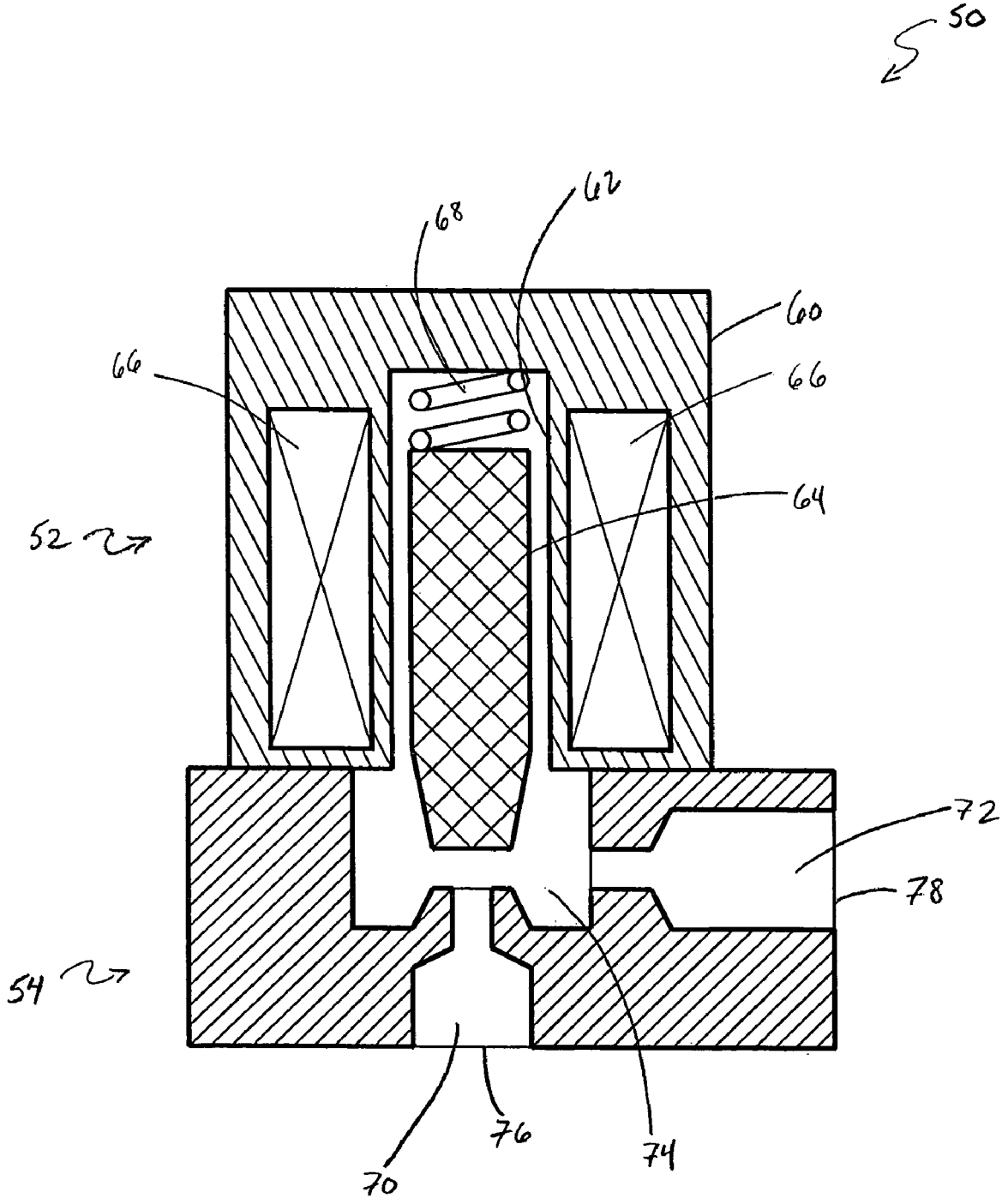
FIG. 3, in a cross-sectional view, illustrates a 2-way control valve without a protective diaphragm.

FIG. 3 illustrates in a sectional view, a 2-way control valve 50 of a solenoid type. The control valve comprises a solenoid assembly 52 that is sealably attached to a fluid manifold 54.

The solenoid assembly 52 comprises a U-shaped housing 60 that defines an armature guide channel 62. A magnetic armature 64 is inserted moveably in the armature guide channel 62. Solenoid control valves are controlled by an electric current that generates a magnetic field. Encased in the housing 60 are the solenoid elements 66 for providing the motive force to the armature 64. The magnetic field causes the armature 64 to be displaced axially in the armature guide channel 62. It will be well understood by those skilled in the art that there are other potential means of providing the valve actuation that include, but are not limited to pneumatic, mechanical or manual means.

The fluid manifold 54 comprises an inlet fluid channel 70, an outlet fluid channel 72, and a connecting chamber 74. The inlet fluid channel 70 and the outlet fluid channel 72 are in periodic fluid communication depending on the position of the armature 64. The fluid channels 70 and 72 form an inlet port 76 and an outlet port 78, respectively, for the control valve 50.

FIG. 3 shows the armature 64 in a first position, in which the armature 64 permits fluid communication between the inlet fluid channel 70 and the chamber 74. Included in the armature guide channel 62 is a biasing means that moves the armature to a second position (not shown) when the solenoid elements 66 are not electrically charged such that fluid communication between the inlet fluid channel 70 and the chamber 74 is interrupted. In this case, the biasing means is shown as a spiral-shaped return spring 68. When an electric current is used to generate a magnetic field, the armature 64 will move from the second position to the first position (shown in FIG. 3), opening the inlet fluid channel 70 so that control fluid flow from inlet fluid channel 70 is permitted to flow into chamber 74 and out through outlet fluid channel 72.

Decorative fountains are often operated in outdoor locations or in environments where the input stream may contain foreign matter and debris, such as rocks, or vegetation. Control fluid supply lines upstream of the control valve may easily transport debris of a size that can clog and impair the operation of the control valve. Blockages caused by debris can lead to damage, malfunctions, reduced performance, premature wear, and the need for increased maintenance of the control valves for fluid amplifier devices in a decorative fountain system.

It is also typical that the initial start-up of a fountain is done under construction site conditions. There will often be a great deal of dust and airborne particles from stonework, drywall and many other general and common construction methods. It is normal for the fountain to be started without adherence to cleaning and line flushing requirements. A properly maintained water feature will also have clean, neutral (i.e. pH-balanced) water. At construction, this is generally not the case. It is also common for a lack of maintenance generally to lead to a chemical imbalance in the fountain permitting the water to become corrosive. It is not unusual for water to infiltrate the control stream circuit.

Another issue is the increase in the use of salt-water chlorine generators for swimming pool water treatment where decorative fountain effects are sometimes desired. The water has a low salt content (2,500 to 6,000 ppm) but it acts as an excellent electrolyte that accelerates corrosion.

Accordingly, one problem with the control valve as illustrated in FIG. 3, is that working components of the valve 50, such as the armature 64 and return spring 68, are not isolated from the control fluid. These components of the valve 50 have close tolerances such that their operation can easily be impaired by dirt and debris. Further, the armature 64 can be susceptible to corrosive fluids.

Figure 4:
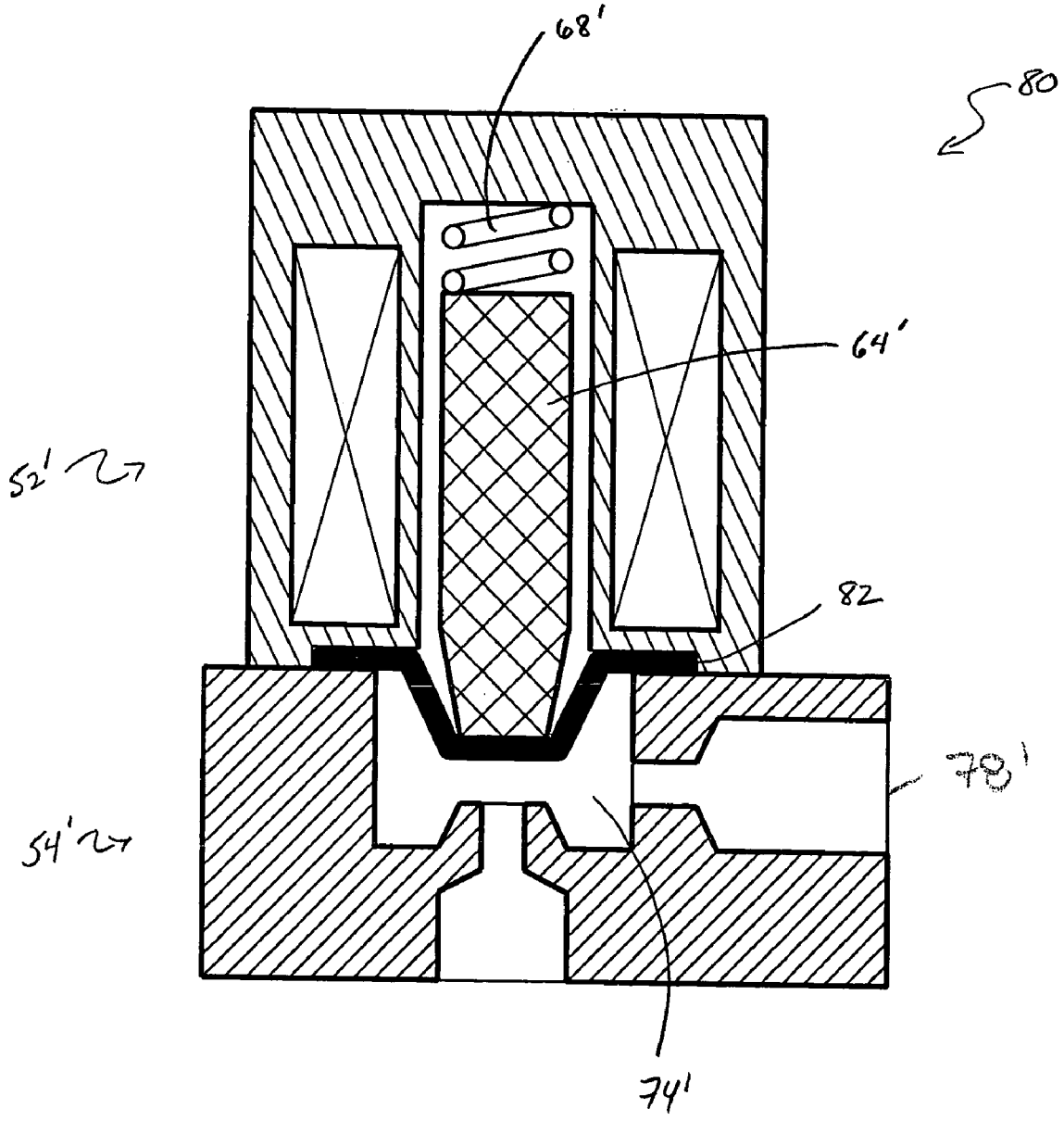
FIG. 4, in a cross-sectional view illustrates a 2-way control valve incorporating a protective diaphragm.

Referring to FIG. 4, a 2-way media isolation solenoid type control valve 80 incorporating a protective diaphragm for use with a fluid amplifier of a fountain is shown in a sectional view. For clarity, the same reference numerals, together with an apostrophe, are used to designate elements analogous to those described above in connection with FIG. 3. However, for brevity, the description of FIG. 3 is not repeated with respect to FIG. 4.

In the valve 80 of FIG. 4, a diaphragm 82 sealingly connects the solenoid assembly 52' and the fluid manifold 54' such that the armature 64' and return spring 68' are isolated from the chamber 74' and direct contact with the control fluid. The diaphragm 82 is preferably composed of a flexible, durable elastomeric material, but may also be made of other suitable materials.

Figure 5:
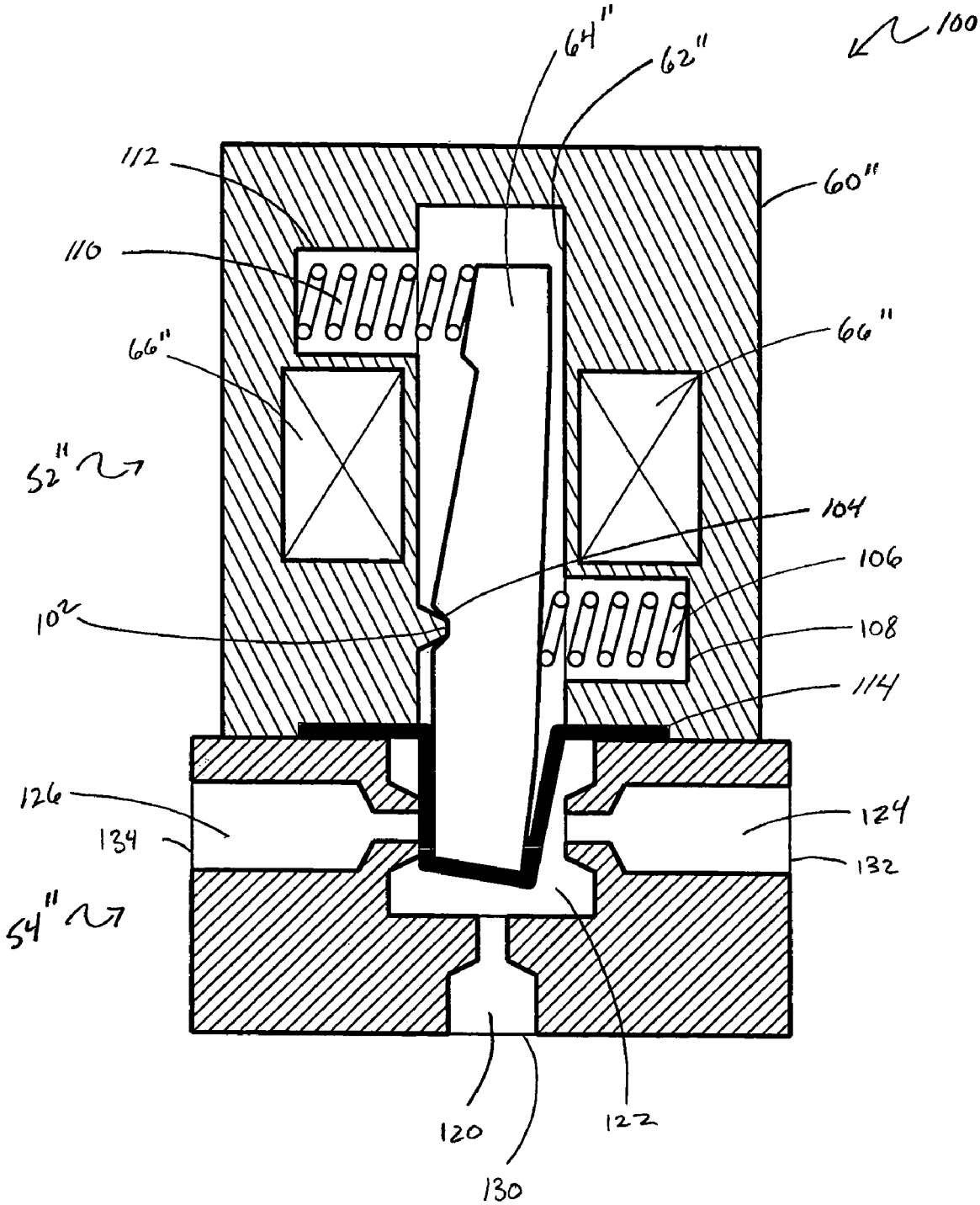
FIG. 5, in a cross-sectional view, illustrates a 3-way control valve incorporating a protective diaphragm.

A second example of a valve that may be used with a fluid amplifier for a fountain is illustrated in FIG. 5 as a 3-way media isolation solenoid type control valve 100, which also incorporates a protective diaphragm. For clarity, the same reference numerals, together with a double apostrophe are used to designate elements analogous to those described above in connection with FIGS. 3 and 4. However, for brevity, the description of FIGS. 3 and 4 is not repeated with respect to FIG. 5.

A sectional view of a 3-way media isolation solenoid type control valve 100 is illustrated in FIG. 5. This control valve 100 includes a solenoid assembly 52", a fluid manifold 54", and an armature 64". In this case the armature 64" pivots on a fulcrum 102 suitably located on a wall of the armature guide channel 62". The fulcrum 102 pivotally communicates with a notch 104 in the armature 64". A first biasing means 106 is inserted in a first recess 108 situated opposite the fulcrum 102 on the opposing wall of the armature guide channel 62" such that the armature 64" is held against the fulcrum 102 without restricting its ability to pivot. A second biasing means 110 is inserted in a second recess 112.

The fluid manifold 54" contains an inlet fluid channel 120 that is in constant fluid communication with fluid chamber 122. On opposing walls of fluid chamber 122 there are a first outlet fluid channel 124 and a second outlet fluid channel 126. The inlet fluid channel 120 forms the inlet port 130, and outlet fluid channels 124 and 126 form the first and second outlet ports 132 and 134, respectively, for the control valve 100.

In operation, when there is no electric current to generate a magnetic field, it is shown in FIG. 5 that the second biasing means 110 causes the armature 64" to pivot about its fulcrum 102 to removeably seal outlet fluid channel 126. When a suitable electric current is supplied to the solenoid elements 66", the armature 64" will pivot about its fulcrum 102 to removeably seal outlet fluid channel 124. By this means, a control fluid provided via inlet fluid channel 120 will be directed, via either one of outlet fluid channels 124 and 126. The control valve 100 also includes a media isolation diaphragm 114 that isolates the armature 64" and other working components from the control fluid.

Figure 6:
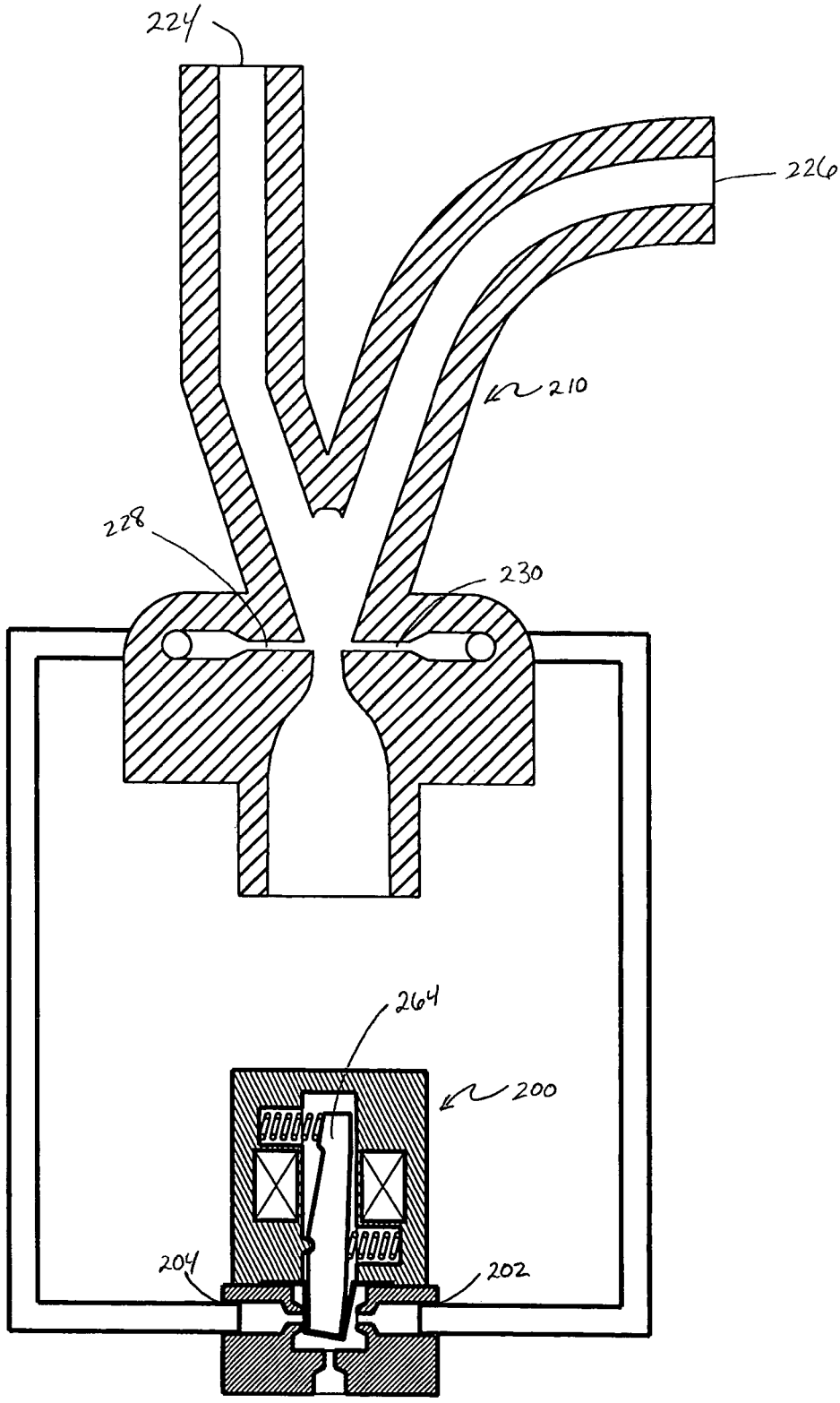
FIG. 6, in a cross-sectional view, illustrates a fluid amplifier incorporating the 3-way solenoid valve of FIG. 5 in accordance with a preferred embodiment of the present invention.

FIG. 6 illustrates a media isolation control valve 200, similar to that illustrated in FIG. 5, in operational engagement with a fluid amplifier 210. For clarity, the same reference numerals, increased by 200, are used to designate elements analogous to those described above in connection with the fluid amplifier 10 of FIG. 1. However, for brevity, the description of FIG. 1 is not repeated with respect to FIG. 6. The first and second outlet ports 202 and 204 of media isolation control valve 200 are in constant fluid communication with the control stream channels 228 and 230 of the fluid amplifier 210. Preferably, this media isolation control valve 200 is used to vent a control fluid flow consisting of air at atmospheric pressure, but as mentioned above, any suitable control fluid may be used. Through operation of the media isolation control valve 200 as described above, the power stream flow can be selectively diverted to either the display port 224 or the exhaust port 226.

Figure 7:
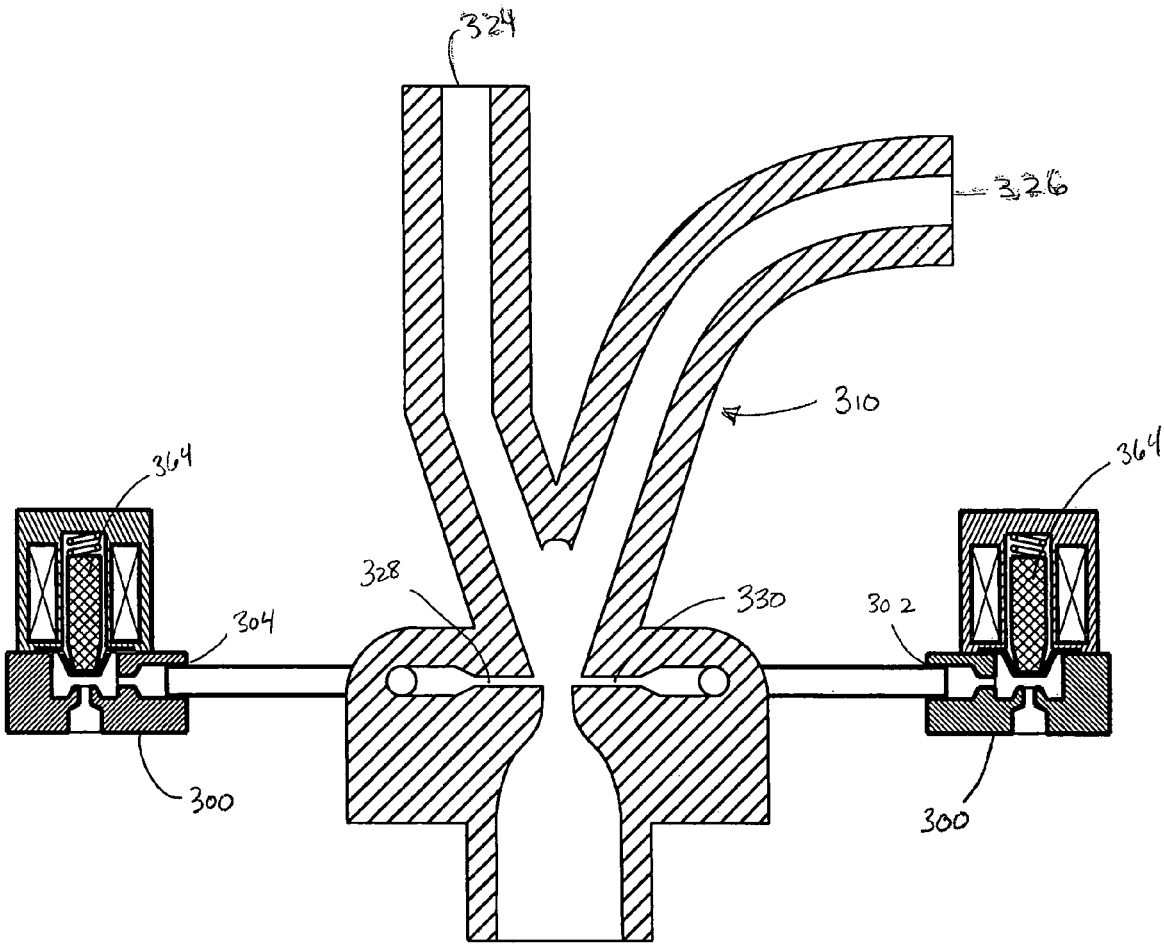
FIG. 7, in a cross-sectional view, illustrates fluid amplifier incorporating the 2-way solenoid valve of FIG. 4 in accordance with a second preferred embodiment of the present invention.

Referring now to FIG. 7, while it is preferable to use a three-way media isolation valve, optionally at least one 2-way media isolation control valve 300, similar to that illustrated in FIG. 4, may be used. For clarity, the same reference numerals, increased by 300, are used to designate elements analogous to those described above in connection with the fluid amplifier 10 of FIG. 1. However, for brevity, the description of FIG. 1 is not repeated with respect to FIG. 7. In this case, of course, two distinct valves would preferably be used; one for each of control stream channels 328 and 330 of the fluid amplifier 310 of FIG. 7. As shown in the example illustrated in FIG. 7, the outlet ports 302 and 304 of the two media isolation control valves 300 are in direct fluid communication with the control stream channels 328 and 330 of the fluid amplifier 310. Through the operation of the media isolation control valves 300 as described above, the power stream flow can thereby be selectively diverted to either the display port 324 or the exhaust port 326. In this case, it will be appreciated by one skilled in the art that a means of coordinating the reciprocal activation of the respective media isolation control valves 300 will be required to ensure switching of the power stream flow is effected as desired.

Preferably, the control valves 200 and 300, illustrated in FIGS. 6 and 7 respectively, are configured such that they have an operating cycle of at least five cycles per second, and, more preferably, have an operating cycle of twenty cycles per second. That is, in order to sustain fountain effects, the power stream flow must be diverted back and forth between display port 224 or 324 and exhaust port 226 or 326. To achieve this, the armature 264 or 364 must be moveable back and forth at a rate of at least five cycles per second, to selectively seal outlet fluid channels 202 and 204, or 302 or 304 thereby switching the power stream flow back and forth between display port 224 or 324 and exhaust port 226 or 326.

Preferably, to ensure that an adequate control fluid flow is provided to switch the power stream back and forth between the exhaust port and the display port, the outlet ports should be at least one-eighth of an inch in diameter. That is, in the case of the fluid amplifier 310 of FIG. 7, which incorporates to control valves 300, similar to control valve 80 illustrated in FIG. 4, the outlet ports 302 and 304 of each of these control valves 300 should be at least one-eighth of an inch in diameter. Correspondingly, in the case of the fluid amplifier 210 of FIG. 6, the outlet ports 202 and 204 of the control valve 200, which is in operational engagement with the fluid amplifier 210, should be at least one-eighth of an inch in diameter.

In a further aspect of the present invention, the control valves are specially adapted to be robust and operable in a decorative fountain environment. In particular, the control valves are adapted to be submersible in that the electrical components has been sealed against water penetration to protect these components from water or other liquids to protect electrical components from water penetration. In addition, if a gas is used as the control fluid, measures may be needed to prevent the infiltration of water into the control fluid supply circuit. These measures or adaptations may include, but are not limited to, the inclusion of seals, gaskets, insulated wiring, waterproof adhesives, or other liquid impermeable compounds.

Other variations and modifications of the invention are possible. For example, instead of the two control valves 300 operationally engaged with the fluid amplifier 310 of FIG. 7, only a single 2-way media isolation control valve need be used. In this case, only one side of the interaction chamber would include a control stream channel for providing a control stream. In one valve position, this control stream would be interrupted, and the fluid amplifier otherwise oriented such that a boundary layer effect is generated between this side wall and the power stream, thereby directing the power stream through one of two output ports. When the 2-way control valve is operated to provide a control stream through the control channel, this boundary layer would be disrupted, and the flow would attach to the opposite side of the interaction region, thereby directing the power stream out of the opposite exhaust port. All such modifications or variations are believed to be within the sphere and scope of the invention as defined by the claims appended hereto.

The invention claimed is:

1. A fluid amplifier comprising:

an interaction chamber;

an upstream conduit for issuing a power stream flow into the interaction chamber;

a plurality of output channels located downstream of the interaction chamber;

a first control stream channel in fluid communication with the interaction chamber for controllably directing a first control fluid flow into the interaction region;

a second control stream channel in fluid communication with the interaction chamber for controllably directing a second control fluid flow into the interaction region; and, at least one control valve for controlling at least one of the first control fluid flow and the second control fluid flow, the at least one control valve having a movable element for selectively opening and closing at least one of the first control stream channel and the second control stream channel, and a diaphragm for isolating the moveable element.

2. The fluid amplifier as defined in claim 1, wherein the at least one control valve further comprises at least one electrical component for selectively moving the moveable element, and a protective housing for protecting the at least one electrical component, the protective housing being sealed against water such that the at least one control valve is water-submersible.

3. The fluid amplifier as defined in claim 1 wherein the at least one control valve comprises a single three-way control valve further comprising:

a control stream inlet for providing a control fluid flow to a control fluid manifold;

a first control fluid outlet for providing the first control fluid flow to the first control stream channel; and a second control fluid outlet for providing the second control fluid flow to the second control stream channel;

wherein the moveable element is operable to alternately block and open the first control fluid outlet and the second control fluid outlet to control the first control fluid flow and the second control fluid flow.

4. The fluid amplifier as defined in claim 3 wherein the first control fluid outlet and the second control fluid outlet are at least one-eighth of an inch in diameter.

5. The fluid amplifier as defined in claim 1 wherein the at least one control valve comprises a first 2-way control valve and a second 2-way control valve, wherein the first 2-way control valve comprises: (i) a first control fluid manifold; (ii) a first control fluid inlet for providing a first control fluid to the first control fluid manifold; (iii) a first control fluid outlet for providing the first control fluid flow to the first control stream channel; (iv) a first moving component for selectively opening and closing the first control fluid outlet to control the first control fluid flow within the first control stream channel;

the second 2-way control valve comprises: (i) a second control fluid manifold; (ii) a second control fluid inlet for providing a second control fluid to the second control fluid manifold; (iii) a second control fluid outlet for providing the second control fluid flow to the second control stream channel; and (iv) a second moving component for selectively opening and closing the second control fluid outlet to control the second control fluid flow within the second control stream channel; and, wherein the moveable element comprises the first moving component and the second moving component, and the diaphragm comprises a first diaphragm element for isolating the first moving component and a second diaphragm for isolating the second moving component.

6. The fluid amplifier as defined in claim 1 wherein the first control fluid outlet and the second control fluid outlet are greater than one-eighth of an inch in diameter.

7. The fluid amplifier as defined in claim 1 wherein the moveable element of the at least one control valve has an operating rate of at least five cycles per second, such that the moveable element can selectively open and close at least one of the first control stream channel and the second control stream channel at least five times per second.

8. The fluid amplifier as defined in claim 7 wherein the moveable element has an operating speed of at least 20 cycles per second.

* * * * *